US005787822A

United States Patent [19]

Hilliard

[11] Patent Number: 5,787,822

[45] Date of Patent: Aug. 4, 1998

[54] OBLATE SPHEROID SHAPED GASIFICATION APPARATUS AND METHOD OF GASIFYING A FEEDSTOCK

[75] Inventor: Wesley P. Hilliard, Huntington, Utah

[73] Assignee: Emery Recycling Corporation, Salt Lake City, Utah

[21] Appl. No.: 653,499

[22] Filed: May 24, 1996

[51] Int. Cl.[6] ..... F23G 5/12

[52] U.S. Cl. ..... 110/229; 110/235; 110/346; 48/76; 48/111

[58] Field of Search ..... 110/204, 205, 110/229, 235, 346; 48/76, 111

[56] References Cited

U.S. PATENT DOCUMENTS

| | | | |
|---|---|---|---|
| 927,418 | 6/1909 | Pettibone | 48/209 |
| 1,849,279 | 3/1932 | Cezanne | 48/76 |
| 2,306,030 | 12/1942 | Zeuch | 48/76 |
| 2,805,188 | 9/1957 | Josenhans | 201/4 |
| 2,890,107 | 6/1959 | Flesch et al. | 48/206 |
| 3,471,275 | 10/1969 | Borggreen | 48/209 |
| 3,707,129 | 12/1972 | Kwashimo et al. | 110/228 |
| 3,746,521 | 7/1973 | Giddings | 48/111 |
| 3,874,116 | 4/1975 | White | 48/209 |
| 3,918,374 | 11/1975 | Yamamoto et al. | 110/346 |
| 4,142,867 | 3/1979 | Kiener | 48/76 |
| 4,152,122 | 5/1979 | Feldmann | 48/111 |
| 4,306,506 | 12/1981 | Rotter | 110/229 |
| 4,308,807 | 1/1982 | Stokes | 110/257 |
| 4,309,195 | 1/1982 | Rotter | 48/76 |
| 4,459,136 | 7/1984 | Linneborn et al. | 48/111 |
| 4,530,702 | 7/1985 | Fetters et al. | 48/209 |
| 4,718,362 | 1/1988 | Santén et al. | 110/345 |
| 4,732,091 | 3/1988 | Gould | 110/229 |
| 4,977,840 | 12/1990 | Summers | 110/346 |
| 5,069,765 | 12/1991 | Lewis | 204/173 |
| 5,089,030 | 2/1992 | Michel-Kim | 48/76 |
| 5,138,957 | 8/1992 | Morey et al. | 110/234 |
| 5,213,051 | 5/1993 | Kaneko | 110/229 |
| 5,484,465 | 1/1996 | Hilliard et al. | 48/76 |

OTHER PUBLICATIONS

Ming-Yen Wey, Ben-Horng Liou, Shu-Yii Wu, and Ching-Hong Zhang, The Autothermal Pyrolysis of Waste Tires, *Journal of the Air and Waste Management Association*, vol. 45, pp. 855-863 (Nov. 1995).

*Primary Examiner*—Henry A. Bennett
*Assistant Examiner*—Pamela A. O'Connor
*Attorney, Agent, or Firm*—Madson & Metcalf

[57] ABSTRACT

Apparatus and method for gasification of feedstock materials are disclosed. The apparatus includes an oblate spheroid (egg-shaped) gasification chamber having inlets for feedstock material and gaseous oxidizer. A combustion gas outlet permits removal of combustion gases, and an ash collection region allows collection and removal of ash produced in the gasification chamber. A plurality of recirculating venturi tubes located within the gasification chamber recirculate combustion gases and particulates into and out of a gasification zone. Each venturi tube includes a plenum having a gaseous oxidizer inlet and a plurality of orifices capable of producing high velocity air flow towards the feedstock material bed in the gasification zone. Filtration action of the bed entrains combustion particulates. A plurality of air cannons coupled to one or more pulse valves provide pulsed air flow into the gasification zone to agitate the feedstock material bed. Gaseous oxidizer inlets in the ash collection region allow control of the ash carbon content. Advantageously, the gasification device does not have moving internal parts. The agitation and recirculation is controlled by the gaseous oxidizer pulses and input into the gasification chamber.

20 Claims, 5 Drawing Sheets

OBLATE SPHEROID SHAPED GASIFICATION APPARATUS AND METHOD OF GASIFYING A FEEDSTOCK

BACKGROUND OF THE INVENTION

1. Field of the Invention

The present invention relates to a gasification apparatus for gasifying feedstock material, including municipal, industrial, construction, and agricultural waste materials and non-waste materials such as wood and coal. The present invention reduces the disposal volume of solid waste materials and produces a gaseous fuel that can be recovered for use in various applications. In particular, the present invention relates to improvements for controlled autothermo-gasification of waste materials wherein the waste is subject to a recirculation within the combustion unit. As a result of the process of the present invention, the feedstock material is reduced in volume by at least 90%, but not limited to this percent of reduction, and a clean gaseous fuel is produced without creating any adverse effect on the environment from its use. The currently preferred gasification process is accomplished in a single oblate spheroid-shaped gasification reactor, although modifications of this shape can be used.

2. Technology Background

Disposal of waste materials has been and continues to be a major problem in our society. The quantity of solid waste is ever increasing, and the land needed for conventional landfills is rapidly disappearing. Landfills in and of themselves present problems. Refuse deposited in landfills often takes over 30 years to decompose. During that period other ecological problems are generated. Pollutants leaching from the refuse into the water table have become a significant concern, and the problems of odors and atmospheric pollution are numerous. Of further concern is the fact that the disposal of solid waste in a landfill has often resulted in unexpected long term hazards due to ground pollution caused by the nature of the waste as well as due to uneven settling of the landfill site long after the landfill has been converted to other uses.

The most widely used alternative to landfill waste disposal is incineration in open air or in forced air incineration plants. Conventionally, in the course of incineration, burning of the refuse is carried out in a combustion chamber into which air is introduced for purposes of combustion. As part of the incineration, the organic materials from the waste material must be converted into materials that will burn uniformly in the combustion chamber. Solid waste materials vary so widely in composition and in its moisture content that the combustion reaction cannot be adequately controlled and maintained. Incomplete combustion of the waste is common, with resulting emission to the atmosphere of large quantities of smoke and pollution. Even though it is desirable to incinerate or burn solid waste to reduce its volume, neither open air burning nor forced air incineration is environmentally acceptable because of the air pollution problems inherent with the processes.

Numerous systems have been proposed for pyrolysis and gasification of waste materials. While pyrolysis techniques offer a number of theoretical advantages, pyrolysis systems for handling common waste have just begun to achieve some significant commercial use. This evolution of pyrolysis technology is beginning to achieve acceptable status in the art of disposing of municipal solid waste ("MSW"). Older gasification methods involve, at lease in part, certain heat transfer problems incurred due to the large variance in composition and moisture content of the waste.

Because of the variance in composition and moisture content of municipal waste, it is difficult to control the temperature for proper pyrolysis of the waste without avoiding localized increases in temperature that result in slagging. For example, to achieve relatively steady state operating when gasifying common MSW, temperatures in the older systems were used that approach the temperatures at which slagging of inorganic material will occur. The inorganic components of the MSW, then melt to form a tenaciously adhering coating of slag on all surfaces exposed to the waste.

Systems have been proposed for conversion of solid waste materials by high temperature gasification into gaseous fuels called producer gas. Such systems usually comprise a vertically oriented chamber having sequentially descending, drying, distilling, oxidizing and reducing reaction zones. Again, due to the large variances in the composition of municipal waste as well as the moisture content of the waste, gasification systems have not been amenable to adequate controls required for these various feedstocks. Prior systems have been plagued with operational problems as well as serious pollution problems resulting from the inability to remove undesirable compounds and elements from the gas stream and their ultimate release to the atmosphere from use of the fuel gas.

Most known gasification systems avoid feedstock fuels having a very high sulphur content, such as rubber. Experimental tests show that gasifying a 90 percent rubber waste stream with a 10% excess $O_2$ effluent stream creates conditions which produce 1100 ppm $SO_2$. Cutting the excess $O_2$ to 3.9% reduces the $SO_2$ a proportionate amount. The presence of excess $O_2$ can be attributed to blow holes in the fuel bed.

Environmental considerations mandate the removal of $SO_2$ in the effluent discharge gas of any combustion process of a commercial scale. This is a major concern of any combustion process and is of major economic concern in the design of the equipment. The higher the incidence of $SO_2$ downstream of the gasifier, the larger and more expensive the equipment needed to remove them. Thus, to reduce costs, high sulfur fuels are avoided.

The carbon content of the ash fraction is also an important consideration of the design and operation of a gasification system. Where once 20% to 50% carbon in the ash was common, now 3% to 5% carbon in the ash is desirable. Any form of indirect pyrolysis leaves large percentages of carbon in the ash primarily due to insufficient content of molecular oxygen to make the conversion from carbon to a fixed stable gas. Thus, pyrolysis is undesirable unless there is an economically viable use for the char. Without an economically viable use of char the high carbon in the ash represents a loss of efficiency of the system. It would be an advancement in the art to be able to control the carbon content in the ash.

To avoid excessive carbon content in the ash, sufficient oxygen must be admitted to the reaction chamber in the form of air, pure gaseous oxygen, or in the form of an oxygen rich solid. To be effective, gaseous oxidants must have intimate contact with the fuel carbon fraction for sufficient time to allow the reaction to take place.

If the fuel bed is of optimum dimension and the path length through the reactor is sufficient for the oxidant to be fully reacted, there is still the problem of blow holes, or low resistance channels, through the bed unless the oxidant is administered at small differential pressures (low velocity) across the fuel bed. These low velocities make it very difficult to maintain the reaction at optimum temperatures, and they decrease fuel throughput and gas output for given reactor size. Although satisfactory results are obtained initially, the situation rapidly deteriorates over time because the oxidant can pass directly through the fuel bed into the output gas stream without reacting with the fuel.

From the foregoing, it will be appreciated that a fixed bed is not a good choice for the counter current reduction of municipal waste because of the incidence of excess oxygen which encourages the formation of $SO_2$. This is directly affected by the difficulty of obtaining a uniform fuel particulate size. One approach has been to agitate the bed with a paddle or series of paddles and or arms. This only agitates a portion of the fuel bed at any given time and still relies on a permeable fuel bed. If, during the reaction, the fuel becomes a very fine ash that promotes excess back pressure for the oxidant flow, then this stirred bed behaves as a fixed bed susceptible to blow hole formation.

A variation on the stirred bed is the use of a rotating table or tuyere beneath the bed. However, a rotating tuyere provides minimal fuel bed agitation in the higher zones and allows finer fuel and entrained ash particles to accumulate and interfere with the bed's overall permeability. As the permeability drops, back pressure on the oxidant supply rises until it forces its way through the bed. Thus, the fuel bed begins to exhibit lower resistance channels through the bed with characteristic high $SO_2$ output.

The methods of agitation described above do not allow for a variation in fuel size or consistency that can be economically obtained with solid waste materials. To gasify a varied feedstock fuel source, like municipal, industrial, construction, and agricultural waste, the apparatus must be capable of adjusting to operating conditions over a broader range of control than are required of systems designed to use a homogeneous feedstock. The permeability of the fuel bed is shown to be of primary concern and is affected adversely by changes in the fuel fraction that goes through a liquid stage when it encounters the temperatures within the gasifier.

From the foregoing background, one would expect "fluidizing" conditions would be able to provide controllable intimate contact with such a varied fuel structure. Unfortunately, conventional fluidizing conditions provide excess oxygen which is not tolerable because of $SO_2$ production.

Another significant problem with conventional gasification devices is the inability to account for the wide variance in composition of the feedstock material as well as the variance in the moisture content of such waste. High water content feedstock can significantly reduce the operating temperature of the gasifier. Another contributor to this "quenching action" are materials in large percentages in the feed stream that have the opportunity to go through a liquid phase. Wide variation in operating temperature makes it difficult to control the combustion of the feedstock material and affects material throughput and subsequent output.

The following are some of the reasons that conventional apparatus for the gasification of solid fuel (wood and coal) will not consistently gasify municipal waste:

(a) Low fuel bed permeability or variations in permeability.

(b) High tendency to form channels through fuel bed structure.

(c) Fuel fines either in the raw fuel or created in the course of the process contributing to entrained particles in the effluent stream and permeability.

(d) High percentage of liquid phase materials and the variability in percentage of these materials.

(e) High initial moisture content of the fuel.

(f) Low gas terminal velocity to prevent particulate and large condensable agglomerations from being entrained.

Conventional gasifiers do not adequately address these parameters which must be dealt with on a continuously changing basis. Accordingly, it would be a significant advancement in the art to provide an improved apparatus for gasification of feedstock fuel materials.

Such apparatus for gasification of feedstock materials are disclosed and claimed herein.

SUMMARY OF THE INVENTION

The present invention provides an environmentally acceptable method and apparatus for gasification of feedstock materials such as municipal, industrial, construction, and agricultural waste. The present invention may be readily adapted for gasifying conventional solid gasification fuels such as coal and wood. A preferred embodiment of the present invention provides a method and apparatus for gasifying solid waste material which eliminates emission of smoke and other pollutants to the atmosphere.

The organic material in the feedstock is converted to a relatively clean producer gas and ash. The ash has a volume typically less than about 10% of the volume of the starting waste material. The resulting solid ash material is sterile and environmentally innocuous. The producer gas and the solid ash material can be used for Various commercial purposes. For example, the ash can be used as a soil conditioner, for ice removal on highways, as a concrete additive, as a paving additive, and the producer gas can be used as a clean burning fuel. Alternatively, the gas can simply be burned and the ash can be buried in conventional fashion in a landfill.

A currently preferred apparatus for feedstock gasification according to the present invention includes a single gasification chamber in the shape of an oblate spheroid. One presently preferred oblate spheroid is a geodesic oblate spheroid (GOS). Feedstock fuel material is introduced into the gasification chamber using a feeder. It is important that the selected feeder design be able to introduce feedstock material into a pressurized gasification chamber. The feeder design can vary depending on the feedstock material to be gasified. For instance, used tires can successfully be fed into the reaction with a compression feeder. This kind of feeder will allow accurate feedstock feed control and permit tires to be introduced to the pressurized gasification chamber. Other conventional feed valves, including conical feed valves, are useful for introducing dried or partially dried waste feedstock material within the pressurized gasification chamber. Examples of conical feed valves are disclosed in U.S. Pat. No. 5,484,465, issued Jan. 16, 1996, which patent is incorporated by reference.

Centrally located around the interior perimeter of the gasification chamber are one or more recirculating venturi tubes. The precise number of recirculating venturi tubes can vary depending on the size of the gasification chamber and the type of waste material being gasified. Each venturi tube includes a recirculating gas inlet, a recirculation channel; a plenum, and a venturi gas outlet directed towards the gasification zone. The plenum contains a gaseous oxidizer inlet and a plurality of orifices which direct the gaseous oxidizer through each venturi tube and add motive power for gas recirculation.

The gaseous oxidizer is preferably air, but can include oxygen, oxygen enriched air, or other gaseous oxidizers. Other reactive gases can also be introduced into the plenum and mixed with the recirculating gas flow to cause desired chemical reactions within the gasification chamber. Approximately 50% of the gaseous oxidizer is preferably introduced to the gasification chamber through the plenum/venturi gas inlet. This amount can be varied depending on the composition of the feedstock material and the desired gasification products. The gaseous oxidizer introduced into the gasification chamber through the venturi tubes affects the resultant gaseous recirculation flow and the number of times the volatilizing feedstock material passes through the gasification zone.

The gasification chamber preferably includes gaseous oxidizer inlets at two other distinct locations within the gasification chamber. One or more air cannons are located below the venturi gas outlets, and a plurality of gaseous oxidizer inlets are located below the gasification zone in the ash collection region. Air cannons can optionally be located in the ash collection region.

The air cannons are directed towards the gasification zone to provide pulsed air flow into the gasification zone which agitates and fluidizes the waste material bed. Agitation is controlled by the operating frequency and pressure of pulse valves coupled to the air cannons. The use of air cannons and air pulse valves enables the elimination of all interior mechanical moving parts. The sinusoidal wave pulses of the air cannons insure the complete agitation of all unreacted material which has not completely gasified and controls the oxidizer balance needed for gasification.

The gaseous oxidizer inlets located within the ash collection region are used to control the carbon content of the resulting ash. Larger amounts of oxidizer will promote complete combustion of carbonaceous waste materials. Ash carbon content below 5% by weight can be obtained. Alternately, little or no oxidizer within the ash collection region will result in incomplete combustion of the feedstock material which can result in the preparation of high-carbon ash, such as carbon black.

Chemical reactants can be introduced within the gasification chamber to react with the feedstock material or its byproducts. The recirculating operation of the gasification chamber permits prolonged residence time and reaction time of the chemical reactants. An example of a typical chemical reactant within the scope of the present invention is a chemical compound for dry scrubbing to control undesirable sulfur oxides (SOx) or other undesirable compounds. Various known and novel chemical scrubbing compounds can be used with the present invention including, but not limited to, calcium, limestone, lime, and oil shale. The chemical reactants are preferably added to the gasification chamber through the feedstock feed inlet, although a separate inlet can be provided for such compounds.

BRIEF DESCRIPTION OF THE DRAWINGS

Preferred embodiments of apparatus in accordance with the present invention representing the best mode presently contemplated of carrying out the invention are illustrated in the accompanying drawings in which.

DETAILED DESCRIPTION OF THE INVENTION

The present invention is directed to an apparatus and method for gasification of various feedstock materials. The invention will be described in greater detail with reference to presently preferred embodiments thereof illustrated in the Figures.

Figure 1:
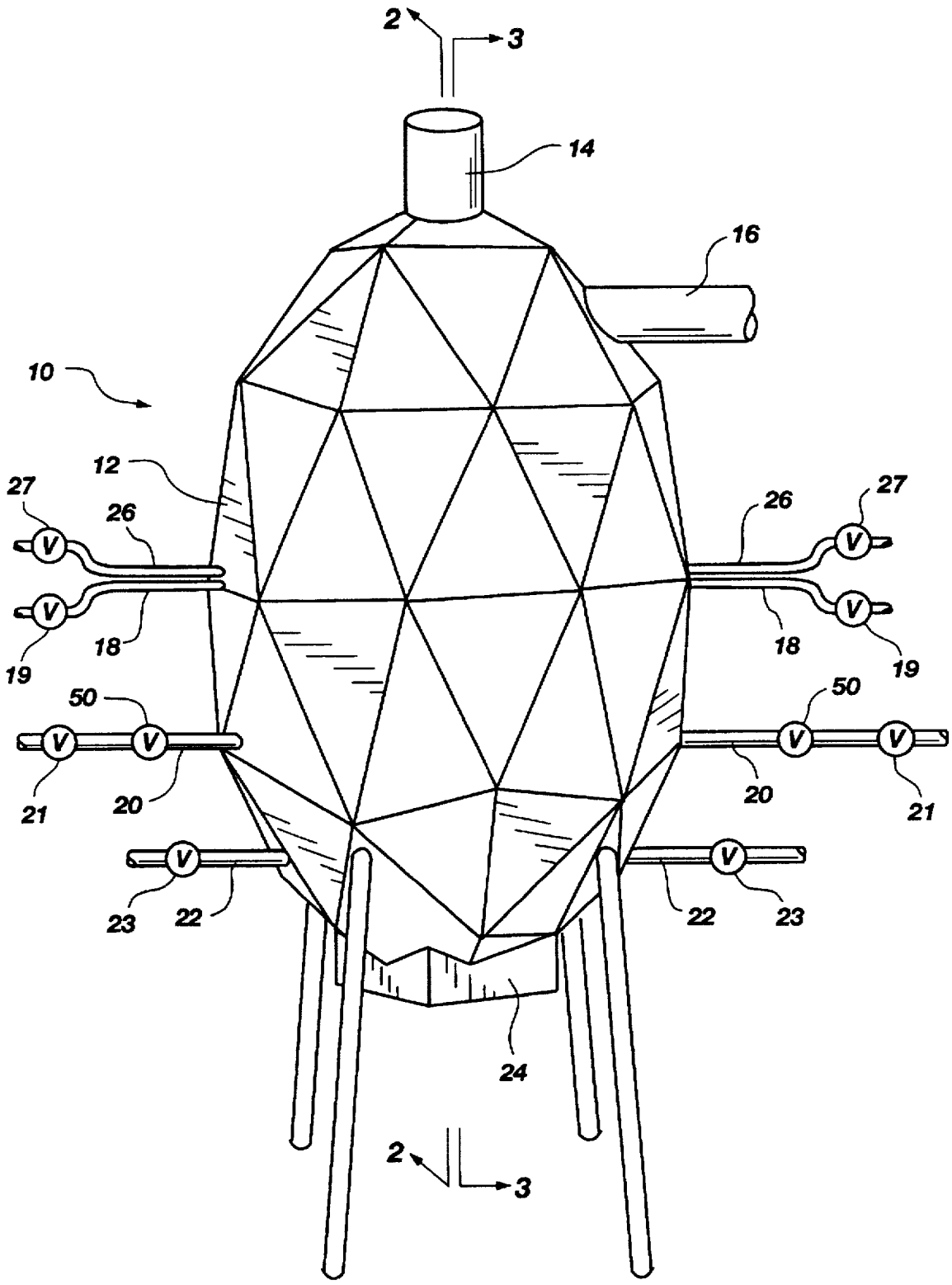
FIG. 1 is a perspective view of a geodesic oblate spheroid waste gasification apparatus within the scope of the present invention.
Figure 2:
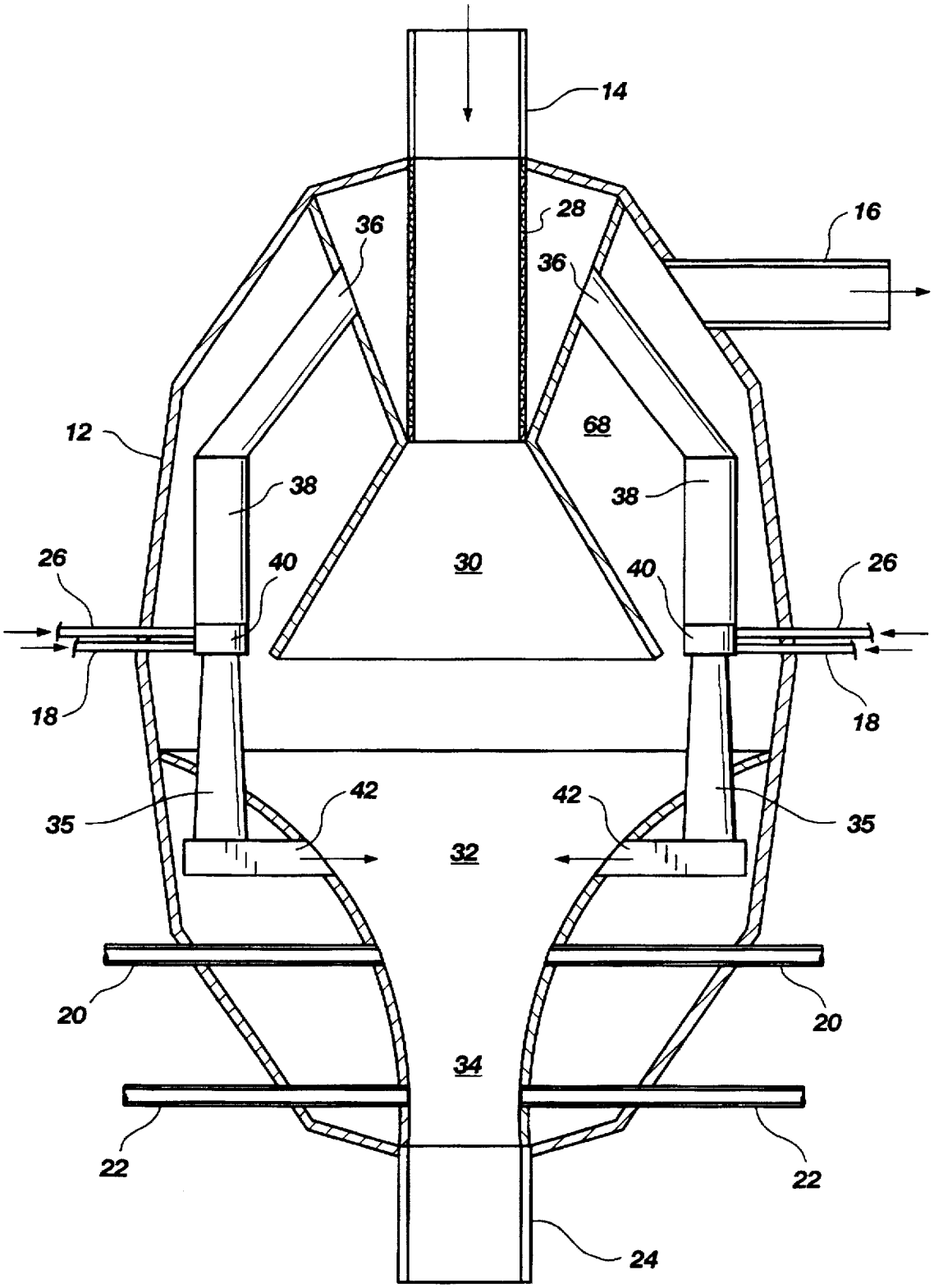
FIG. 2 is a cross sectional view taken along line 2—2 of FIG. 1 showing the interior of the waste gasification apparatus.
Figure 3:
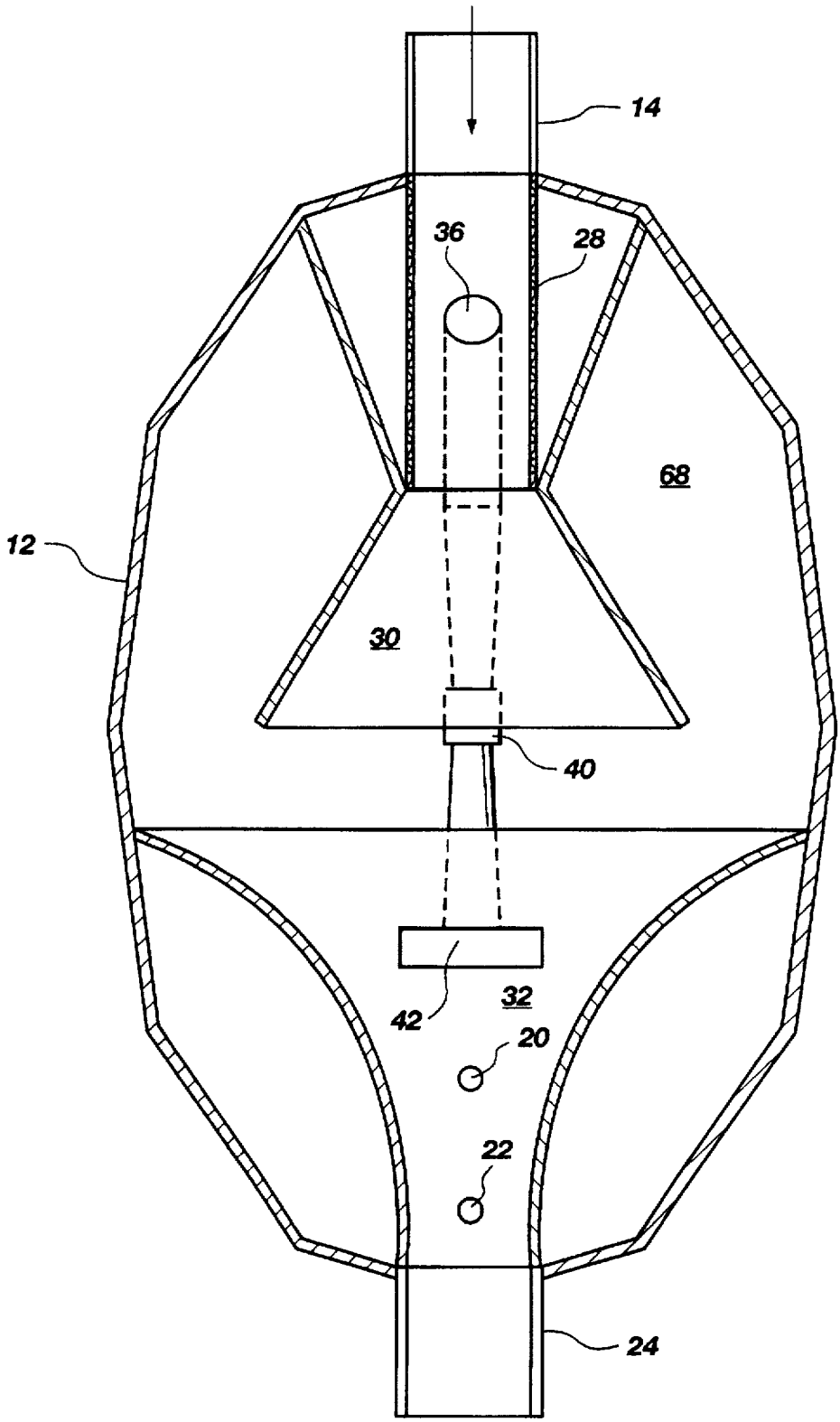
FIG. 3 is a cross sectional view taken along line 3—3 of FIG. 1 showing the interior of the waste gasification apparatus.

Referring to FIG. 1, a currently preferred gasification system is generally designated 10. The gasification system 10 according to the present invention illustrated in FIG. 1 includes a geodesic oblate spheroid-shaped gasification chamber 12. The gasification chamber 12 includes a feedstock material inlet 14. As shown in FIG. 1–3, the feedstock material inlet 14 is preferably located in an upper region of the gasification chamber 12. A combustion gas outlet 16 permits removal of combustion gases from the gasification chamber 12. The combustion gases typically contain a mixture of condensable hydrocarbon compounds and fuel gases which can be recovered for its fuel or raw material value. A plurality of gaseous oxidizer inlets 18, 20, and 22 allow introduction of gaseous oxidizer into various internal regions within the gasification chamber 12. The gaseous oxidizer inlets 18, 20, and 22 are preferably coupled to valves 19, 21, and 23, respectively, for controlling the pressure and flow rate of the gaseous oxidizer flowing through the inlets. An ash outlet 24 allows removal of the ash product of the feedstock material gasified. The ash outlet 24 can include known or novel ash gates (not shown) or similar devices for removal of ash while maintaining the pressure within the gasification-chamber 12. A gaseous fuel inlet 26 permits supplemental fuel to be introduced into the gasification chamber during start-up of the gasification process to heat the gasification chamber to a desired operating temperature. The gaseous fuel inlet 26 is preferably coupled to valve 27 for controlling the pressure and flow rate of the gaseous fuel. An igniter (not shown) is preferably included within the gasification chamber 12 to ignite the gaseous fuel or feedstock material. The supplemental fuel can also be introduced to the gasification chamber as needed to further control the gasification process.

FIGS. 2 and 3 illustrate the internal configuration of the gasification chamber 12. A feedstock material channel 28, constructed of a screen or mesh material, conveys feedstock material from the feedstock material inlet 14 to a volatilization zone 30. As illustrated, the volatilization zone 30 has a generally downward diverging shape which opens into a gasification zone 32. Feedstock material entering the volatilization zone becomes partially volatilized. Volatiles and light particulates are drawn upward, as explained in greater detail below, while the heavier, non-volatilized feedstock descends into the gasification zone 32. The volatilization zone represents the upper portion of a volatilization column extending through the center axis of the gasification chamber 12. As illustrated, the gasification zone 32 gradually narrows to form an ash collection region 34 for collecting ash generated by gasification of feedstock material.

Figure 4:
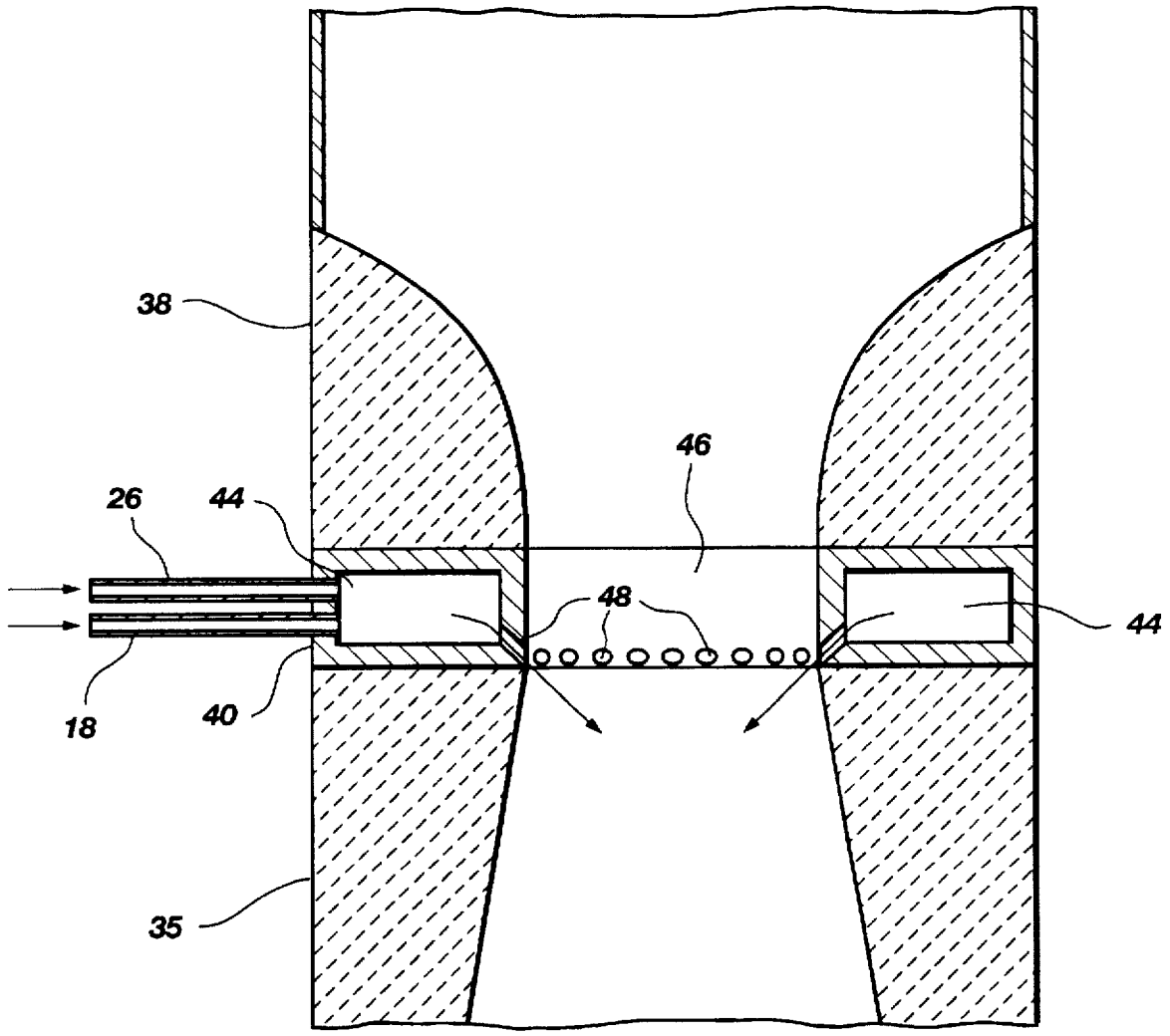
FIG. 4 is an enlarged cross sectional view of the plenum within the recirculating venturi tube shown in FIG. 2.

The gasification chamber includes one or more recirculating venturi tubes 35. Each venturi tube includes a recirculating gas inlet 36 located above the volatilization zone 30, a recirculation channel 38, a plenum 40, and a venturi gas outlet 42 directed towards the gasification zone 32. As best shown in FIG. 4, the plenum defines an annular chamber 44. The gaseous oxidizer inlet 18 and the gaseous fuel inlet 26 enter the annular chamber 44. The plenum 40 has an interior ring 46 which diverges through the venturi 35. The plenum ring 46 contains a plurality of orifices 48. The orifices 48 allow gaseous oxidizers or other reactive gases to pass from the plenum into the venturi tube 35. The orifices 48 are preferably directed downward. This causes gaseous oxidizer from the gaseous oxidizer inlet 18, and optionally fuel from the gaseous fuel inlet 26, to be directed downward through the venturi tube 35 towards the venturi tube outlet 42.

As shown in FIG. 4, the recirculation channel 38 narrows such that the cross sectional opening is approximately equal to the size of interior ring 46. The cross sectional area venturi 35 gradually increases between the plenum 40 and the venturi gas outlet 42.

The venturi 35 is preferably constructed of a refractory material capable of withstanding high temperatures. A refractory material is currently preferred over conventional steel to construct the venturi 35 because it can withstand the high temperatures immediately downstream of the plenum 40. Of course, steel or other construction materials can be used, but they are generally not as durable as refractory materials. The wall thickness of the venturi 35 is preferably thicker near the plenum 40 to further help withstand the high temperatures. The portion of the recirculation channel 38 closest to the plenum 40 is also preferably constructed of a refractory material, while the remainder of the recirculation channel 38 is preferably constructed of steel. The plenum 40 is preferably constructed of steel so that it can be machined to contain the orifices 48 and annular chamber 44.

The gaseous oxidizer inlets 20 are preferably coupled to air pulse valves 50 to provide pulses of gaseous oxidizer at various frequencies and pressures. The oxidizer inlets 20 coupled to pulse valves 50 are referred to herein as air cannons because of their ability to introduce periodic bursts of oxidizer into the gasification chamber 12 and more specifically into the gasification zone 32. The air cannons preferably provide sinusoidal air pulses ranging in frequency from 20 Hz to 3 KHz and at a pressure sufficient to agitate the feedstock bed. The operating pressure can vary depending on the size of the gasification chamber 12 and the material being gasified. Pressures can range from 1 to 1000 psi, with typical operating pressures ranging from 1 psi to greater than 90 psi.

As used herein, the term "air" associated with air cannon, air pulse, and air pulse valve is intended to include other forms of gaseous oxidizers in addition to atmospheric air. It is also contemplated that other reactive gases can be introduced within the gasification chamber to react with the combustion gases. Examples of such reactive gases include, but are not limited to, carbon dioxide, methane, propane, super-heated steam, etc.

Figure 5:
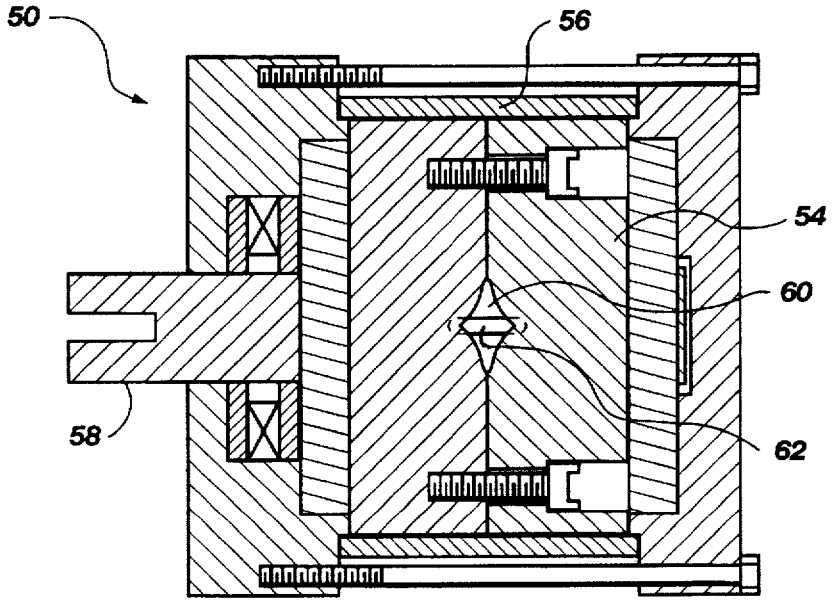
FIG. 5 is a cross sectional view of a pulse valve rotator assembly.
Figure 6:
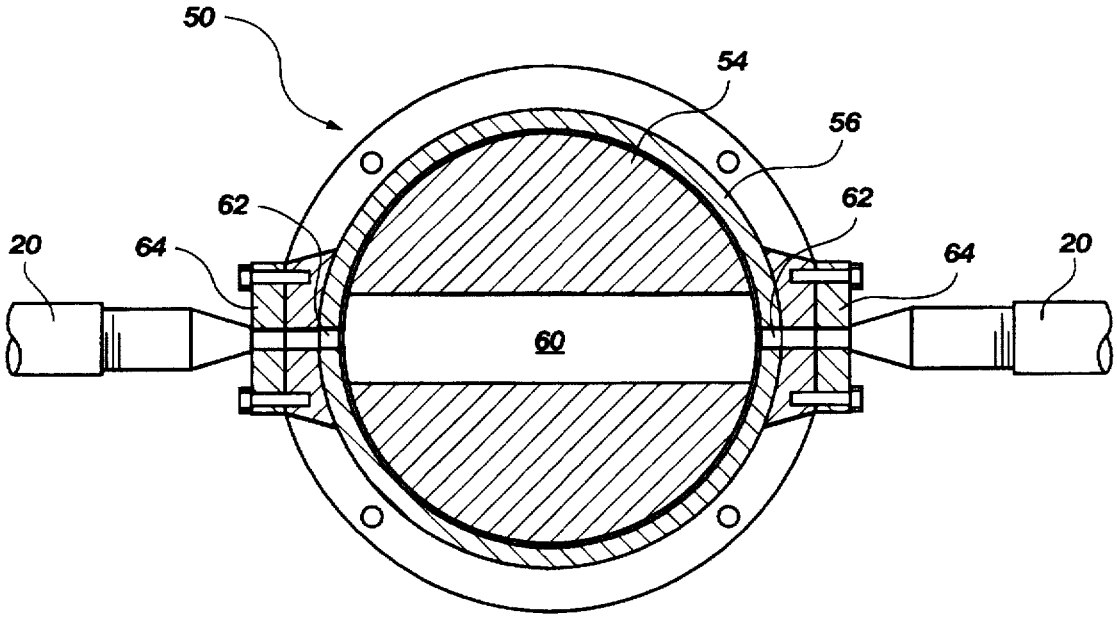
FIG. 6 is another cross sectional view of the pulse valve showing a means for attaching the valve to conventional gas piping.

FIGS. 5 and 6 illustrate cross sectional views of one currently preferred pulse-valve 50 within the scope of the present invention. As shown in FIGS. 5 and 6, a rotor 54 is housed within a case 56. The rotor 54 rotates about an axial shaft 58 attached to a motor (not shown). Through the center of the rotor 54 is a modified diamond-shaped bore 60. A pair of slots 62 are located on opposite sides of the case 56, such that when the bore 60 and slots 62 are in alignment, a gaseous passageway is formed through the pulse valve 50. An air discharge flange and pipe 64 is coupled to the case 56 to allow the pulse valve 50 to be attached to the gaseous oxidizer inlet 20.

As the rotor 54 rotates within the case 56, the interaction between the geometric shapes of the modified diamond-shaped bore 60 and the slots 62, in combination with high pressure gas within the gaseous oxidizer inlet 20, creates the sinusoidal gaseous pressure pulse described above.

The gaseous oxidizer inlets 22 which direct gaseous oxidizer within the ash collection region 34 are used to control the carbon content of the resulting ash. Larger amounts of oxidizer promote more complete combustion of carbonaceous feedstock materials. With excess oxidizer, ash carbon content below 5% by weight can be obtained. Little or no oxidizer within the ash collection region causes incomplete combustion of the feedstock material which can result in the preparation of carbon black.

The present invention is directed to an apparatus and method with a broad range of application for gasification of feedstock materials, including waste materials. Feedstock material used herein includes, but is not limited to, municipal solid waste (including tires), industrial, construction, and agricultural waste and even non-waste material as coal and wood. The presently preferred gasification apparatus is a single gasification chamber shaped as a geodesic oblate spheroid, but not limited to this design shape, with a fixed feedstock material bed being conical in cross section and counter current in configuration which creates ever increasing oxidizing conditions as feedstock material descends to the ash collection region. The height of the gasification chamber can be varied to increase or decrease the reactive path length through the gasifier apparatus and vary the volatilization zone.

The following is an explanation of a method of gasifying feedstock material in an oblate spheroid gasification chamber described herein. In this discussion, the feedstock material is used tires, but it should be realized that the following discussion can apply to other types of feedstock materials including waste and non-waste materials.

The used tires are preferably fed into the gasification chamber by an extrusion type feeder using pressure sufficient to extrude rubber from the tires into the feedstock material inlet 14. The high pressure extrusion system serves a second purpose of providing a seal to the atmosphere within the inlet 14. It is important that the selected feeder design be able to introduce feedstock material into a pressurized gasification chamber. Various feeder designs can be used depending on the feedstock material to be gasified. For instance, conical feed valves, such as those disclosed in U.S. Pat. No. 5,484,465, are useful for introducing dried waste material within the pressurized gasification chamber.

When the feedstock material feed enters the volatilization zone 30, the feedstock material becomes partially volatilized by the heat from the gasification zone 32. The solids, liquids and vaporized material separate. The vapors and light particulates are drawn upward towards the recirculating venturi inlets 36, and the heavier solids and liquids continue to fall downward towards the gasification zone 32 and ultimately form a feedstock material bed within the gasification zone 32 and the ash collection region 34.

The gasification chamber 12 uses one or more recirculating venturi tubes 35 to draw off volatilized material just above the gasification zone 32, which is the most highly oxidized area and the hottest portion of the gasification chamber 12. As the solids and liquids move downward into the gasification zone 32, additional solid and liquid material is vaporized and entrained by the recirculating flow of the venturi tubes 35 which reintroduce the vapors and light particulates into the gasification zone 32. Liquid and vaporized materials are gradually reduced to a noncondensable stable gaseous fuel.

As mentioned above, the gaseous oxidizer inlets 18, 20, and 22 permit control of the combustion and volatilization reactions and the recirculation flow within the gasification chamber such that a stable gaseous product results. The gaseous product is withdrawn from the gasification chamber 12 via combustion gas outlet 16. To exit the gas outlet 16, the gaseous product must enter the freeboard region 68 within the gasification chamber 12. There is low gas velocity within the freeboard region 68 which causes entrained particulates to settle back into the gasification zone 32. This contributes to the low particulate content in the gaseous product.

The use of pulse valves 50 and air cannons associated with oxidizer inlets 20 creates agitation for a consistent permeability within the feedstock material bed. The particulates in the volatilizing material have the opportunity, due to the recirculating flow of the venturi tubes 35, to be filtered by the feedstock material bed, causing a longer residence time at the zone of highest temperature in the gasification chamber 12. In this manner, entrained particulates are continuously removed by the feedstock material bed resulting in a low particulate gaseous product. When chemical reactants are used, such as chemical scrubbing compounds, this recirculating flow increases the residence time for contact with the hot combustion gases, thereby permitting removal of SOx compounds or causing a desired chemical reaction. The use of chemical scrubbing compounds within the gasification chamber eliminates the need for chemical scrubbing downstream of the gasifier.

Air pulse valves 50 can be operated in a synchronous or nonsynchronous manner to provide a sinusoidal wave shape which agitates the feedstock material bed. As mentioned above, the pulse frequency can range from 20 Hz up to 3 KHz, depending on the speed of the valves. The pulse amplitude can be varied by changing the gas pressure typical operating pressures range from 1 psi to several hundred psi. Variation of the oxidizer input and recirculation flow rates provides control of the gasification process and enables use of a variety of different feedstock materials.

The gasification chamber 12 can be operated below temperatures which create most slagging of organic materials. Typical operating temperatures within the gasification zone are in the range from about 350° F. to 2150° F. The condensables in the gas stream exit as vaporized material, where a reduction of the latent heat would allow extraction of these materials. The temperature at which the gasifier operates determines the presence of condensables in the output stream and the production of non-condensable gaseous fuel.

A gaseous oxidizer is preferably introduced into the ash collection region via inlets 22 to control the carbon content of the ash to be below 5%, by weight, or if desired, the oxidizer inlets 22 can be shut off to produce high carbon content ash, such as carbon black.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The claimed invention is:

1. A gasification apparatus comprising: a gasification chamber comprising:

a feedstock material inlet located in an upper region of the gasification chamber;

a volatilization zone located below the feedstock material inlet having a downward diverging shape;

a gasification zone located below the volatilization zone within the gasification chamber;

an ash collection region for collecting ash generated by gasification of feedstock material having a downward converging shape;

at least one recirculating venturi tube having a recirculating gas inlet, a plenum, and a venturi gas outlet directed towards the gasification zone, wherein the plenum contains a gaseous oxidizer inlet and a plurality of orifices which direct gaseous oxidizer towards the venturi gas outlet; and a plurality of air cannons directed towards the gasification zone for providing pulsed air flow into the gasification zone; and a combustion gas outlet for removing combustion gases from the gasification chamber.

2. A gasification apparatus as defined in claim 1, wherein the plenum further contains a gaseous fuel inlet.

3. A gasification apparatus as defined in claim 1, wherein the gaseous oxidizer inlets are coupled to valves for controlling the oxidizer inlet.

4. A gasification apparatus as defined in claim 1, wherein the air cannons include at least one air pulse valve to provide sinusoidal air pulses ranging in frequency from 20 Hz to 3 KHz.

5. A gasification apparatus as defined in claim 1, wherein the air cannons generate air pulses having a pressure ranging from 1 psi to 1000 psi.

6. A gasification apparatus as defined in claim 1, further comprising a plurality of gaseous oxidizer inlets directed towards the ash collection region.

7. A gasification apparatus as defined in claim 1, further comprising a chemical reactant inlet for introducing a chemical reactant to the gasification zone to react with the feedstock material or its by-products.

8. A gasification apparatus as defined in claim 7, wherein the chemical reactant is a chemical scrubbing compound to aid in removal of SOx compounds.

9. A gasification apparatus as defined in claim 1, further comprising a freeboard region in gaseous communication between the gasification zone and the combustion gas outlet, wherein gas velocity within the freeboard region is sufficiently low to cause entrained particulates to settle back into the gasification zone.

10. A gasification apparatus as defined in claim 1, wherein the gasification chamber has an oblate spheroid-shape.

11. A gasification apparatus as defined in claim 1, further comprising a plurality of recirculating venturi tubes.

12. A method of gasifying a fuel feedstock comprising the steps of:

(a) feeding feedstock material into a gasification chamber comprising:

a gasification zone located in a central region within the gasification chamber;

an ash collection region for collecting ash generated by gasification of feedstock material having a downward converging shape; and at least one recirculating venturi tube having a recirculating gas inlet, a recirculation channel, a plenum, and a venturi gas outlet directed towards the gasification zone, wherein the plenum contains a gaseous oxidizer inlet and a plurality of orifices which direct a gaseous oxidizer toward the venturi gas outlet to create a recirculating gaseous flow through the venturi tube toward the gasification zone;

(b) introducing a gaseous oxidizer into the plenum of each recirculating venturi tube to create a recirculating gaseous flow upward from the gasification zone and downward through the venturi tube toward the gasification zone;

(c) providing a pulsed air flow into the gasification zone from a plurality of air cannons directed towards the gasification zone, wherein the pulsed air flow agitates and mixes the feedstock material;

(d) controlling the feed rate of the feedstock material and of the gaseous oxidizer inlets so as to maintain a temperature within the gasification zone in the range from about 350°F. to 2150° F.; and (f) withdrawing combustion gases from the gasification chamber.

13. A method of gasifying a fuel feedstock as defined in claim 12, further comprising the step of volitalizing the feedstock material within the gasification chamber.

14. A method of gasifying a fuel feedstock as defined in claim 13, further comprising the step of introducing a gaseous fuel into the plenum during the igniting step.

15. A method of gasifying a fuel feedstock as defined in claim 12, wherein the pulsed air flow is provided at a sinusoidal frequency ranging from 20 Hz to 3 KHz to control agitation of the feedstock material within the gasification zone.

16. A method of gasifying a fuel feedstock as defined in claim 12, wherein the pulsed air flow is provided at a pressure ranging from 1 psi to 1000 psi.

17. A method of gasifying a fuel feedstock as defined in claim 12, further comprising the step of introducing a chemical reactant to the gasification zone to react with the feedstock material or its by-products.

18. A method of gasifying a fuel feedstock as defined in claim 12, further comprising the step of introducing a gaseous oxidizer into the ash collection region to reduce the carbon content in the ash.

19. A method of gasifying a fuel feedstock as defined in claim 12, wherein the gasification chamber has an oblate spheroid-shape.

20. A gasification apparatus comprising:

a feedstock material inlet for introducing feedstock material into the gasification apparatus;

a gasification zone located within the gasification apparatus for gasifying feedstock material within said gasification zone;

a plurality of air cannons directed towards the gasification zone for providing pulsed air flow into the gasification zone which agitates feedstock material within the gasification zone; and an ash collection region for collecting ash generated by gasification of feedstock material;

at least one recirculating venturi tube having a recirculating gas inlet, a plenum, and a venturi gas outlet directed towards the gasification zone, wherein the plenum contains a gaseous oxidizer inlet and a plurality of orifices which direct gaseous oxidizer towards the venturi gas outlet; and a combustion gas outlet for removing combustion gases from the gasification apparatus.

* * * * *